United States Patent [19]

Jones, Jr.

[11] Patent Number: 4,519,147

[45] Date of Patent: May 28, 1985

[54] FOOTWEAR HAVING CUSHION CAVITY

[75] Inventor: Paul Jones, Jr., Falmouth, Me.

[73] Assignee: Kayser-Roth Corporation, New York, N.Y.

[21] Appl. No.: 383,670

[22] Filed: Jun. 1, 1982

[51] Int. Cl.[3] ..... A43B 9/12

[52] U.S. Cl. ..... 36/19.5; 36/30 A; 36/28

[58] Field of Search ..... 36/19.5, 30 A, 28, 71, 36/15, 16, 22 R, DIG. 1

[56] References Cited

U.S. PATENT DOCUMENTS

| | | | |
|---|---|---|---|
| 1,479,788 | 1/1924 | Ferguson | 36/22 A |
| 1,743,676 | 1/1930 | Mason | 36/30 R |
| 1,861,879 | 6/1932 | Quinn | 36/30 R |
| 2,025,648 | 12/1935 | Daly et al. | 36/24.5 |
| 2,056,313 | 10/1936 | Turner | 12/142 R |
| 2,115,810 | 5/1938 | Gorman | 36/19.5 |
| 2,246,480 | 6/1941 | Weidner | 36/25 R |
| 2,371,912 | 3/1945 | Perrot | 36/25 R |
| 2,438,095 | 3/1948 | Phinney | 36/78 |
| 2,685,750 | 8/1954 | Cristy | 36/17 R |
| 2,707,340 | 5/1955 | Scala | 36/19.5 |
| 2,995,840 | 8/1961 | Greenbaum | 36/19.5 |
| 3,345,664 | 10/1967 | Ludwig | 12/142 R |
| 3,474,478 | 10/1969 | Batchelder et al. | 12/142 R |
| 3,552,041 | 1/1971 | Batchelder et al. | 36/43 |
| 4,176,476 | 12/1979 | Hassell | 36/44 |

FOREIGN PATENT DOCUMENTS

| | | | |
|---|---|---|---|
| 1017009 | 9/1952 | France | 36/28 |
| 1068538 | 6/1954 | France | 36/28 |
| 188306 | 3/1937 | Switzerland | 36/28 |
| 477167 | 12/1937 | United Kingdom | 36/28 |
| 762933 | 12/1956 | United Kingdom | 36/19.5 |

*Primary Examiner*—Henry S. Jaudon
*Assistant Examiner*—T. G. Graveline
*Attorney, Agent, or Firm*—A. Thomas Kammer

[57] ABSTRACT

A cement construction shoe is provided having a soft, flexible insole and a cushioned outsole. In manufacturing the shoe, the insole is temporarily stiffened by a relatively firm member to which it is bonded by means of a wax. This enables the insole to withstand the normal lasting procedure. The outsole is provided with a cavity for receiving a cushion therein. The shoe upper is attached to the outsole such that the insole overlies the cushion. Once the shoe is completed, the wax bond between the insole and its stiffener may be heated to allow the separation and removal of the latter.

6 Claims, 7 Drawing Figures

FIG.6
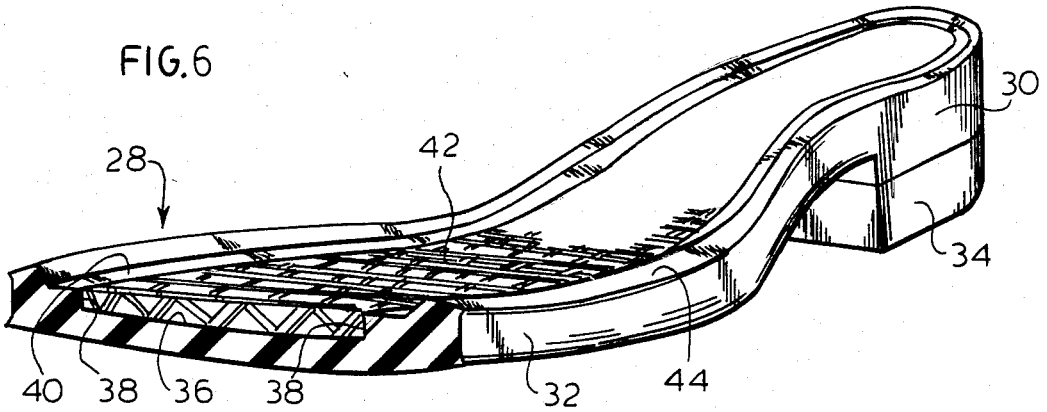
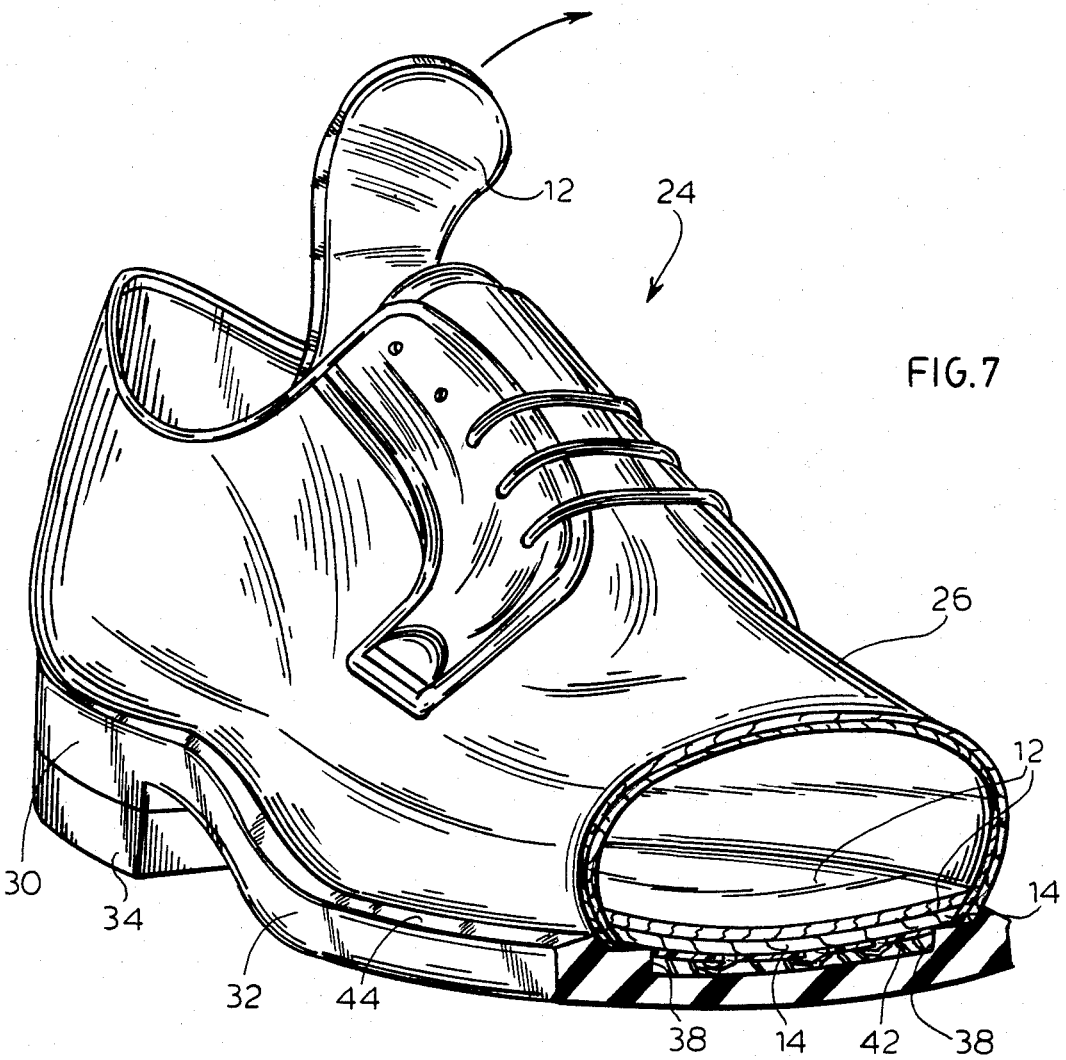
FIG.7

FOOTWEAR HAVING CUSHION CAVITY

BACKGROUND OF THE INVENTION

1. Field of the invention.

The field of the invention relates to the manufacture of footwear having a soft insole and an outsole provided with a cavity for receiving a cushion.

2. Brief description of the prior art.

The manufacture of footwear has involved a number of different processes depending upon the final product which is desired. There are, for example, three basic methods of outsole attachment: cementing, molding, and sewing. Cemented footwear includes any shoe in which the outsole is held in place by means of cement. One type of sole attached by the cement process is known as the "unit sole". A unit sole has generally been defined as an entire sole and heel construction that is molded separately as a single unit. A mold is closed to define a cavity having a desired shape and a soling compound is injected into the cavity. After the unit has been removed from the mold, it may be attached to an upper by the cement process. U.S. Pat. No. 2,995,840 provides an example of a unit sole made by a molding process.

Injection molded shoes are manufactured by placing an assembled upper in position in the loading station of the molding machine, closing the mold, and forcing a soling compound into a cavity formed between the bottom of the mold and the shoe bottom. The process lends itself to the production of casual footwear.

There are a number of sewing processes which are well known to the art for attaching an outsole. Many dress and work shoes today have a welted construction where the outside is stitched to a welt.

Cement construction shoes generally suffer a disadvantage compared to those of welt construction in that there is not enough room between the insole and the outsole for an adequate cushioning material. The unit sole is made of the same material throughout its thickness, and this material must be selected more for its wear resistance than its cushioning effect, especially in dress shoes with light weight edges.

A further disadvantage of the present process for manufacturing cement construction unit soled shoes is that the insole must be made of material that is too firm and stiff for good comfort. This firmness and stiffness are needed to withstand various machine lasting operations without buckling, wrinkling, or moving out of position. Hot melt machine lasting operations are by their very nature fast and forceful as they wipe the taut leather into place against the insole. It is not practical to hold the insole in place with tacks out near the edges, because the tacks would be covered by the lasted over upper, and exceedingly dangerous to the wearer if not removed. As a result, the tacks that temporarily hold the insole must be near the middle, increasing the need for stiffness in the insole. Often cement construction insoles are molded into a shallow compound shape to fit the bottom of the last, and firmness and stiffness are also required to hold the molded shape.

Attempts have been made to temporarily secure a stiffening material to a relatively soft insole by means of LATEX or rubber cement. While this will enable the insole to withstand the lasting process, difficulty has been experienced in removing the stiffener after lasting.

SUMMARY OF THE INVENTION

It is an object of the invention to produce a shoe having maximum comfort for the wearer in an efficient and economical manner.

A unit sole is provided having a heel and outsole made from materials having good wear resistance. A cavity is formed within the unit sole for accomodating a cushion. The cushion is preferably thicker than the cavity in most instances. A cement margin defines the peripheral edges of the cavity, said edges preferably being perpendicular to the outsole. The margin includes a raised peripheral edge. When an upper is attached to the cement margin, the raised peripheral edge prevents one from viewing the bonding between the members and accordingly provides a more attractive appearance.

A soft, flexible insole is also provided by the invention. When used in conjunction with the cushion, a superior fit and more comfort for the wearer are possible. As explained above, insoles must be firm and stiff to resist the action of machines that apply the cement and press the edge of the upper over the edge of the insole. Once the shoe is lasted, however, and especially after the outsole is attached, there is no longer any need for such an insole. This is particularly true where the insole has a good cushioning material beneath it providing resilience and firm support.

To construct a shoe having these desirable qualities, a soft flexible insole is laminated to a piece of inexpensive cardboard or fiberboard or the like with a selected wax. The cardboard is applied to the side of the insole positioned next to the last during the manufacturing process and next to the wearer's foot in the finished shoe. The wax is warmed after the shoe is finished so that the cardboard may be removed therefrom.

BRIEF DESCRIPTION OF THE DRAWINGS

FIG. 6 is a perspective view of a unit sole employed in conjunction with the invention; and FIG. 7 is a partially sectional perspective view of a finished shoe manufactured in accordance with the invention.

DETAILED DESCRIPTION OF THE INVENTION

Figure 1:
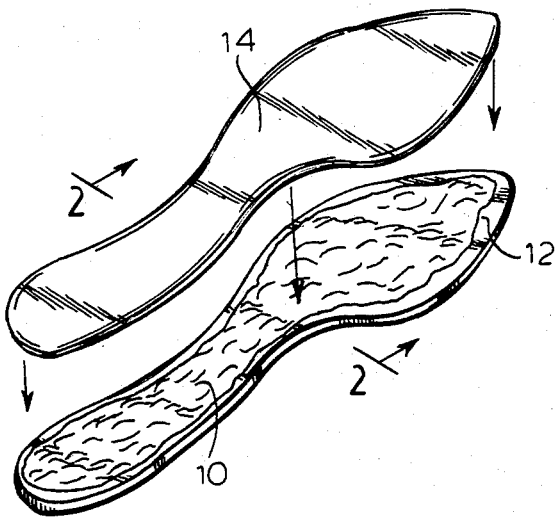
FIG. 1 is a perspective view illustrating the application of a soft insole to a relatively stiff suppott member.
Figure 2:
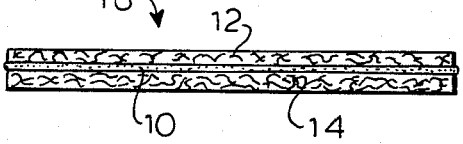
FIG. 2 is a sectional view illustrating the laminate formed by the process shown in FIG. 1, the members shown being enlarged for purposes of illustration.

FIGS. 1–5 illustrate a method of manufacturing an upper of a shoe which may then be cemented to a unit sole to form a finished shoe. A selected wax 10 is melted and then applied by hand or by a standard commercial waxing machine to a relatively stiff cardboard support member 12. A relatively soft leather insole 14 is applied to the waxed side of the cardboard 12. The cardboard is cut with the same die as the insole either before or after it is joined thereto. The laminated structure 16 may be pressed in a hydraulic clicker or cutting press.

The cardboard 12 is positioned on the grain side of the leather which is the side next to the last during the shoemaking process. The wax holds the soft flexible insole 14 to the cardboard with a bond of sufficient strength to allow the laminate 16 to be molded if desired, tacked to the last, and put through the remaining lasting and shoemaking steps with little or no change from the usual process.

Figure 3:
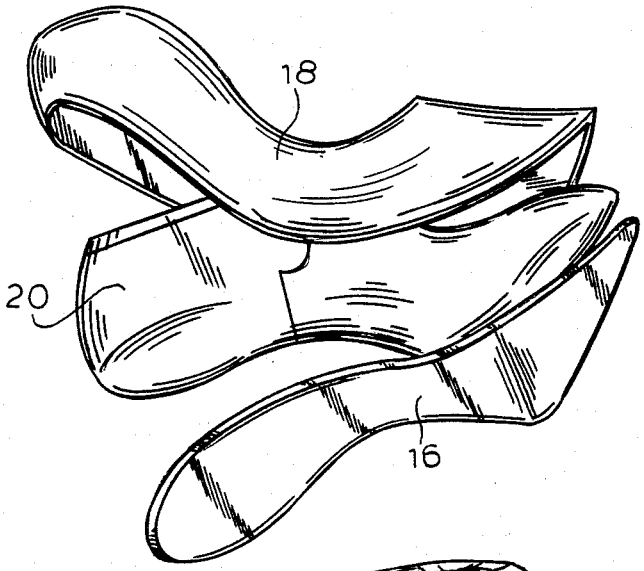
FIG. 3 is a perspective view illustrating the application of an upper and a supported insole to a last.
Figure 4:
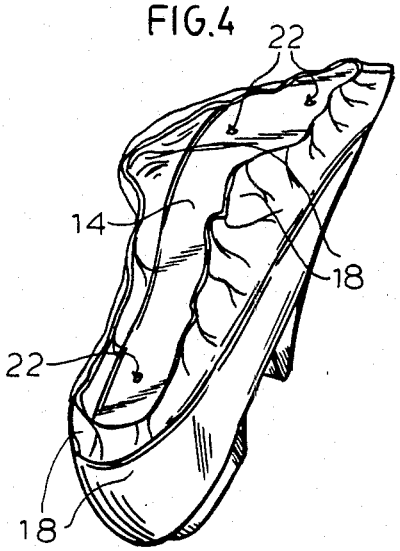
FIG. 4 is a perspective view illustrating the upper assembled to the last before being pulled over and cemented in place.
Figure 5:
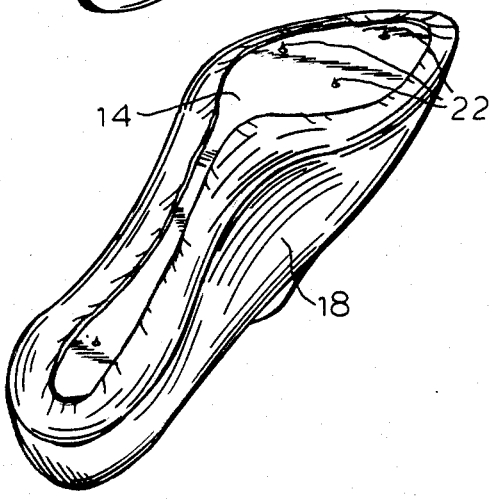
FIG. 5 is a perspective view illustrating the margins of the upper as pulled over and cemented to the insole upon the last.

FIG. 3 illustrates an upper 18 and the laminate 16 being applied to a last 20. Tacks 22 as shown in FIG. 4 are employed to temporarily fasten the center of the laminate 16 to the last. The margins of the leather upper 18 are then pulled over the margins of the laminate as shown in FIG. 5 and cemented thereto. A finished upper is accordingly formed which may be secured to an outsole by the usual procedures used for cement shoes.

After the shoe is lasted and the stiffness of the insole is no longer needed, the wax is heated either through a normal shoemaking step or a special warming operation whereby the bonding decreases and the stiffener can be removed from the shoe. The heat setting operation, and the pump forming operation if used, heat the wax enough to loosen the bond. However, a warm air heat system would be desirable for high production. The cardboard may be removed from the finished shoe 24 as shown in FIG. 7. The insole is given a swab with a cloth covered brush having a handle shaped to reach within the shoe. Any traces of wax remaining on the insole are burnished into the leather in a similar manner to the pasting and polishing of the outside of the shoe. Since the insole is unfinished and porous, the process is both swift and simple.

The wax employed in accordance with the invention is selected to have the correct bonding characteristics for the particular insole and stiffening member used. It should release its bond at a practical temperature and not leave a residue on the insole that will detract from its appeal to a consumer. It will be appreciated that the insole and stiffening members may be made from any materials suitable for their intended purposes. A number of different waxes are suitable for use with soft flexible leather insoles. Some waxes used in the tanning process would be compatible. The wax used herein is a commercially available blend of mostly parrafin and beeswax with selected polymers added to increase tackiness.

The finished upper 26 produced in accordance with the steps shown in FIGS. 1–5 is most advantageously employed in conjunction with the unit sole 28 shown in FIG. 6. The unit sole 28 includes an integrally molded heel 30 and outsole 32. A lift 34 may be secured to the heel 30 if desired.

The unit sole includes a cavity defined by the upper surface 36 of the outsole 32 and the inner edges 38 of a cement margin 40. The upper surface of the cement margin is the surface to which the upper is secured. A cushion 42 is provided within the cavity. The cushion may be inserted after the unit sole is made or may be created at the same time. Various foams may be employed or, alternatively, a material similar to the one described in U.S. Pat. No. 3,790,150 can be used. The cushion should be thicker than the cavity. This has the effect of pre-loading it around the edges when the unit sole is attached to the upper.

The cardboard stiffening member discussed above adds a small amount to the space inside the shoe equal to about a quarter size. The outside appearance of the shoe does not increase in thickness as the laminated insole structure is no thicker than a conventional fibre insole. By making the cavity of the unit sole shallower than the cushion thickness, the cushion will spring back when the last is pulled to offset the effect of the stiffening member. A better transition from the soft cushion to the firm cement margin is also obtained.

Two shoemaking steps should be modified to give full advantage to the wearer of soft flexible insoles and good cushioning between the insole and outsole. One is to skive the perimeter of the flesh side of the upper to obtain a beveled edge. this is most economically done as part of the regular skiving of the uppers. In addition, when roughing the bottom for outsole attachement, the lasted over upper should be roughed down to a feather edge to produce a smooth layer between the cushion and the wearer's foot. The cost of skiving and extra roughing is offset by the fact that the usual felt filler can be omitted.

Unit soles for higher quality shoes usually include provisions for a steel shank to stiffen the rear portion thereof and provide support for the occasional foot that requires it. The unit soles provided herein should have the shank under the cushion and attached to the unit sole rather than on top of the cushion and attached to the insole. The shank can be molded in as part of the unit sole or placed within a recess depending upon whether different shoemakers may want different shanks within the same unit. The shanks may also be laid directly on a plain flat bottom of the cushion cavity. This would require that the shank be thin and flat so that it will not be felt through the cushion and insole.

Some unit soles with thick or heavy edges, particularly ones made with the appearance of a raised platform sole and a higher than average heel, are made with a ribbed surface adjacent the insole. The outside is beneath the ribs and together therewith defines one or more air spaces. These spaces reduce the weight and cost of material. Ordinarily the stiff, firm insole bridges the spaces between the ribs and supports the wearers foot. When such a unit sole is re-designed to provide a cavity for a cushion under the insole, it is necessary to make the cavity sufficiently deeper than the cushion to provide space for a midsole therebeneath. The midsole is designed to provide support for the wearer over the open spaces between the ribs and may be of comparable stiffness to a conventional insole. It can be made from less expensive material, however, since it does not lie directly against the wearer's foot, does not need to absorb much perspiration, and need not adapt to foot shape during the breaking in period.

A raised edge 44 extends upwardly from the cement margin 40 to complement the last and pattern designs of the shoe. Its upper surface may be decorative if desired. Cement shoes without raised edges may be designed in an attempt to make the sole inconspicuous and leave the style impression entirely with the upper.

What is claimed is:

1. A cement shoe comprising:

an upper including an upper member having margin portions;

a soft, flexible insole having margins, said margin portions of said upper overlapping and cemented to said margins of said insole;

a wear resistant outsole including a peripheral cement margin, said cement margin defining a cavity within said outsole, said upper being cemented to said cement margin; and a cushion within said cavity, said insole overlaying said cushion.

2. A shoe as defined in claim 1 wherein said outsole including said peripheral cement margin and said cavity is an integrally molded structure.

3. A shoe as defined in claim 1 wherein said cushion has a greater height than said cavity.

4. A shoe as defined in claim 1 wherein said cushion has substantially the same configuration as said cavity.

5. A shoe as defined in claim 1 including a heel secured to said outsole.

6. A shoe as defined in claim 1 wherein said outsole includes a top surface, said cushion being supported by said top surface and retained in position by said peripheral cement margin, said peripheral cement margin extending substantially perpendicularly with respect to said top surface.

* * * * *